US005351404A

United States Patent [19]

Smith

[11] Patent Number: 5,351,404

[45] Date of Patent: Oct. 4, 1994

[54] CHANGEABLE TIP AWL

[76] Inventor: John W. Smith, 2022 Carmel Rd., Millville, N.J. 08332

[21] Appl. No.: 123,052

[22] Filed: Sep. 20, 1993

[51] Int. Cl.[5] ..... B26F 1/04; B25G 1/08

[52] U.S. Cl. ..... 30/366; 81/177.85

[58] Field of Search ..... 30/358, 366, 16, 164.5, 30/164.9; 81/177.85; 223/104

[56] References Cited

U.S. PATENT DOCUMENTS

| | | | |
|---|---|---|---|
| 78,947 | 6/1868 | Fansworth | 30/366 |
| 908,708 | 1/1909 | Stewart | 223/104 |
| 1,523,022 | 1/1925 | Larson | 81/177.85 |
| 1,756,003 | 4/1930 | North | 81/177.85 |
| 2,390,309 | 12/1945 | Keys | 30/366 |
| 4,631,989 | 12/1986 | Trowbridge | 81/177.85 |
| 4,854,761 | 8/1989 | Smith et al. | 15/244.1 |

FOREIGN PATENT DOCUMENTS

| | | | |
|---|---|---|---|
| 17280 | of 1904 | United Kingdom | 30/366 |

*Primary Examiner*—Richard K. Seidel
*Assistant Examiner*—Paul M. Heyrana, Sr.
*Attorney, Agent, or Firm*—E. Michael Combs

[57] ABSTRACT

An awl member having an elongate shank includes a shank first end spaced from a shank second end, the shank second end having a handle fixedly mounted thereto coaxially aligned with the shank, with the shank first end including an internally threaded bore threadedly receiving and engaging an insert, with the insert including a polymeric lock projection extending through an externally threaded portion of said insert.

4 Claims, 4 Drawing Sheets

CHANGEABLE TIP AWL

BACKGROUND OF THE INVENTION

1. Field of the Invention

The field of invention relates to tool structure, and more particularly pertains to a new and improved changeable tip awl wherein the same is arranged for the ease of replacement of awl tips relative to the awl structure.

2. Description of the Prior Art

Awls of various types have been utilized in the prior art, with the prior art indicating the use of replaceable structure such as in a soldering gun, as indicated in U.S. Pat. No. 5,059,769, with tools such as screw drivers and the like such as indicated in U.S. Pat. No. 5,051,876 having a removable tip structure.

The instant invention attempts to overcome deficiencies of the prior art by providing for an awl having replaceable tips arranged for mounting in a secured relationship relative to an associated shank structure and in this respect, the present invention substantially fulfills this need.

SUMMARY OF THE INVENTION

In view of the foregoing disadvantages inherent in the known types of replaceable tip tool apparatus now present in the prior art, the present invention provides a changeable tip awl wherein the same is directed for the ease of replacement and mounting of tip structure relative to an elongate shank within an awl. As such, the general purpose of the present invention, which will be described subsequently in greater detail, is to provide a new and improved changeable tip awl which has all the advantages of the prior art tool apparatus and none of the disadvantages.

To attain this, the present invention provides an awl member having an elongate shank including a shank first end spaced from a shank second end, the shank second end having a handle fixedly mounted thereto coaxially aligned with the shank, with the shank first end including an internally threaded bore threadedly receiving and engaging an insert, with the insert including a polymeric lock projection extending through an externally threaded portion of said insert.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved changeable tip awl which has all the advantages of the prior art tool apparatus and none of the disadvantages.

It is another object of the present invention to provide a new and improved changeable tip awl which may be easily and efficiently manufactured and marketed.

It is a further object of the present invention to provide a new and improved changeable tip awl which is of a durable and reliable construction.

An even further object of the present invention is to provide a new and improved changeable tip awl which is susceptible of a low cost of manufacture with regard to both materials and labor, and which accordingly is then susceptible of low prices of sale to the consuming public, thereby making such changeable tip awls economically available to the buying public.

Still yet another object of the present invention is to provide a new and improved changeable tip awl which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
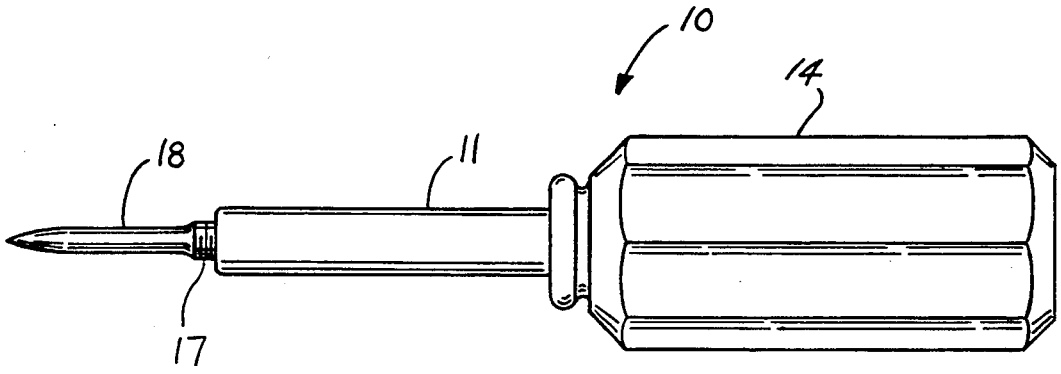
FIG. 1 is an orthographic side view of the invention.
Figure 2:
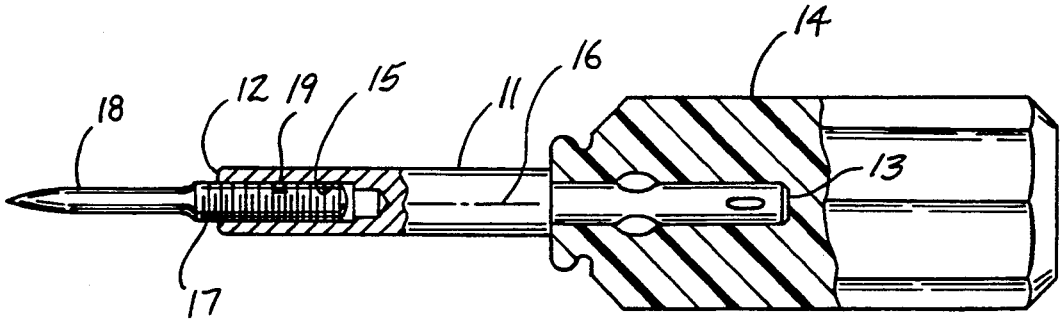
FIG. 2 is an orthographic side view, partially in cross-section, of the invention.
Figure 3:
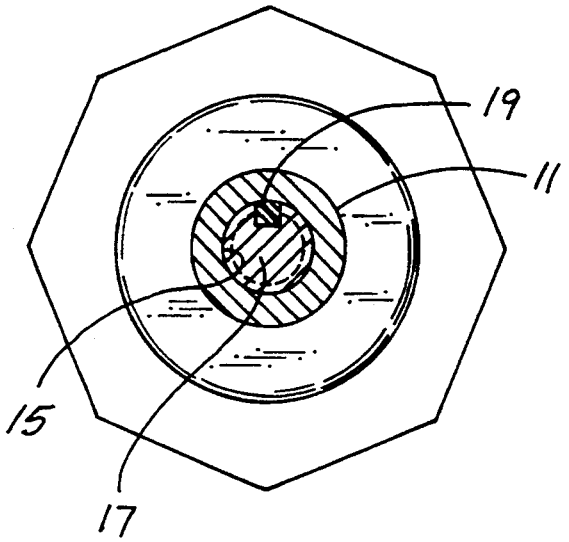
FIG. 3 is an orthographic cross-sectional illustration indicating the use of a polymeric lock insert relative to the awl tip.

With reference now to the drawings, and in particular to FIGS. 1 to 8 thereof, a new and improved changeable tip awl embodying the principles and concepts of the present invention and generally designated by the reference numeral 10 will be described.

More specifically, the changeable tip awl 10 of the instant invention essentially comprises an elongate shank 11 having a shank first end 12 spaced from a shank second end 13, with a handle 14 fixedly mounted to the shank coaxially aligned along a tool axis 16 at the shank second end. An internally threaded bore 15 coaxially aligned along the axis 16 extends into the shank 11 from the shank first end 12 to threadedly receive a threaded shank portion 17, having a pointed awl rod 18 extending coaxially and aligned relative to the threaded shank 17. A polymeric insert 19 projects radially through the threaded shank portion 17 for interlocking engagement with the internally threaded bore 15, in a manner as indicated in the FIGS. 2 and 3 for example.

Figure 4:
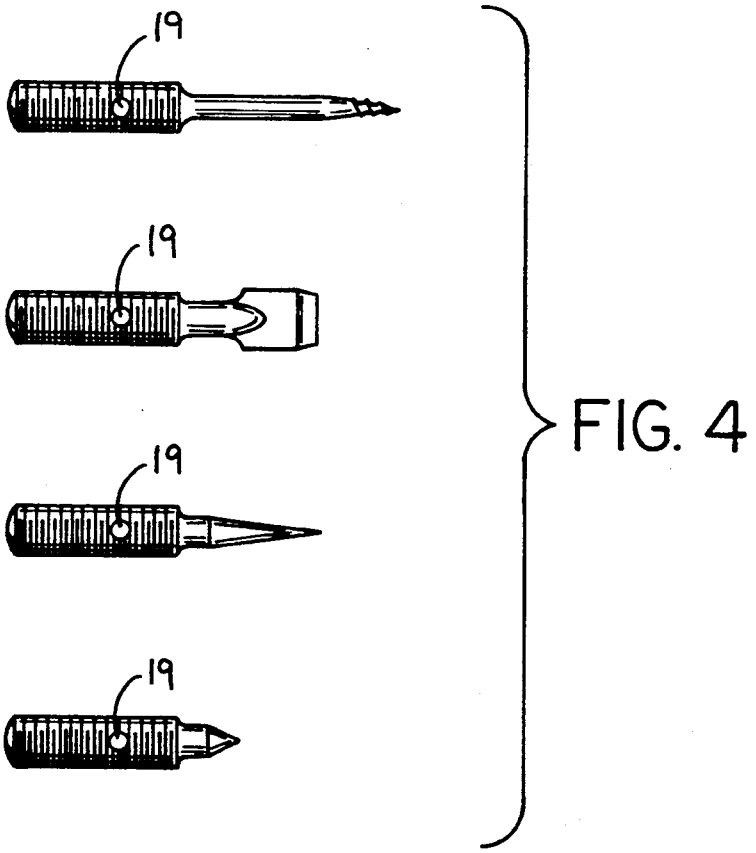
FIG. 4 is an orthographic view of replacement awl tip structure.

The FIG. 4 indicates the use of a plurality of awl structure of various replacement tips, to include a wood corkscrew point, a chisel point, a fine point, and an obtuse point for use in tempered steel. It should be understood that various other tips may be employed, in a manner having the tip coaxially aligned along the threaded shank portion, with each including a polymeric insert 19 for locking engagement with the internally threaded bore 15.

Figure 5:
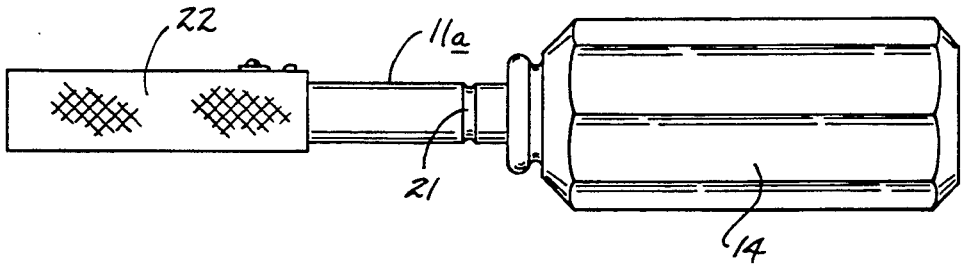
FIG. 5 is an orthographic side view of the invention to further include a protective sleeve.

The FIG. 5 includes a modified shank 11*a* having a rigid protective sleeve 22 slidably directed therealong from a first position, wherein the sleeve extends beyond the pointed awl rod 18 to a second position, wherein the sleeve exposes the awl rod and extends towards and adjacently to the handle 14. To this end, first and second annular grooves 20 and 21 are directed into the shank 11*a*, with the first annular groove positioned in adjacency to the shank first end, with the second annular groove positioned in adjacency to the handle. The sleeve 22 includes a sleeve opening 25 adjacent the sleeve second end 24 that is spaced from the sleeve first end 23. The sleeve second end 24 is arranged in facing relationship relative to the handle 14, with the use of a sleeve opening 25 directed to the sleeve in adjacency to the sleeve second end to receive a V-shaped spring projection 26 mounted to a spring plate 27. In this manner, the V-shaped spring projection 26 is biased through the sleeve opening 25 within the sleeve to engage selectively the first or second annular grooves 20 and 21 relative to the first and second positioning of the sleeve, such as indicated in the respective solid line and phantom line configuration of FIG. 6.

Figure 6:
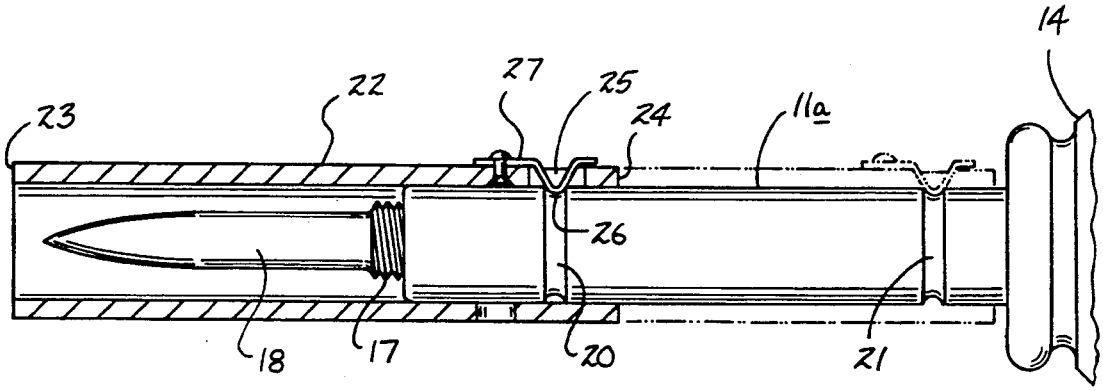
FIG. 6 is an orthographic view, partially in cross-section, of the protective sleeve structure.
Figure 7:
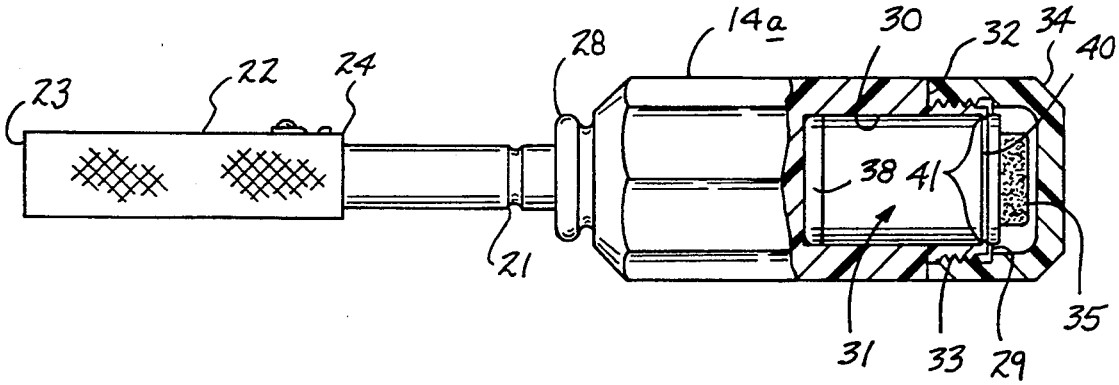
FIG. 7 is an orthographic cross-sectional illustration of a modified handle having indicator apparatus mounted therewithin.
Figure 8:
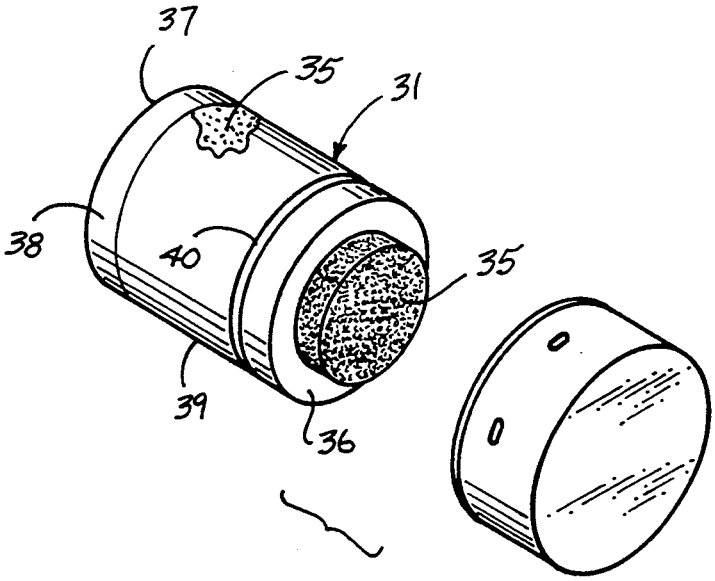
FIG. 8 is an isometric illustration of the indicator container arranged for mounting within the handle structure, as indicated in FIG. 7.

The FIG. 7 further indicates the use, in addition to the structure of the FIGS. 5 and 6, a modified handle 14*a*, having a handle first end 28 spaced from a handle second end 29, with a handle cavity 30 directed into the handle coaxially aligned with the axis 16 through the second end 29, with a container 31 extending beyond the handle second end received within the cavity 30. An annular abutment wall 32 is arranged orthogonally oriented relative to the axis 16 in spaced adjacency to the handle second end, such that an externally threaded handle wall 33 extends from the abutment wall 32 to the handle second end to threadedly receive a handle cap 34 to afford protection to the container during periods of non-use of the container. The container includes a porous sponge applicator 35, with the applicator 35 directed coextensively within the container projecting beyond the container top wall 36, wherein the container bottom wall 37 is of a portion of a removable end cap 38 to provide for replenishment of a marking dye fluid directed to saturate the sponge applicator 35. Various dye such as "PRUSSIAN BLUE" is provided to this end, and the dye per se is known in the mechanical arts permitting scribing through the dye for ease of visual observation of said scribe marks effected by use of the pointed awl rod 18.

The container side wall 39, as illustrated, includes a container annular groove 40 positioned in adjacency into the container top wall 36, such that the handle second end 29 includes an annular and resilient spring lift 41 arranged for projection into the container annular groove 40 to provide for ease of mounting and replacement of the container relative to the handle cavity 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A changeable tip awl, comprising, an elongate rigid shank, having a shank first end spaced from a shank second end, and an elongate handle, with the handle fixedly receiving the shank second end within said handle, and the shank first end including an internally threaded bore directed into the shank from the shank first end, and an awl shank having a threaded shank portion threadedly received within the internally threaded bore, and a pointed awl rod, wherein the pointed rod awl, the threaded shank portion, the internally threaded bore, the elongate shank, and the handle are coaxially aligned relative to one another, and the threaded shank portion having a polymeric insert mounted to the threaded shank portion and projecting beyond the threaded shank portion exteriorly of the threaded shank portion in an interengagement with the internally threaded bore, and a rigid protective sleeve slidably directed along the shank, with the sleeve having a sleeve first end and a sleeve second end, with the sleeve first end arranged for spaced adjacency to the pointed awl rod and extending beyond the pointed awl rod in a first position and arranged for exposing the pointed awl rod in a second position, with the sleeve second end positioned in facing adjacency to the handle, and a first annular groove directed into the elongate shank in adjacency to the shank first end, and a second annular groove directed into the elongate shank in adjacency to the shank second end in adjacency to the handle, with the sleeve having a sleeve opening and a V-shaped spring projection directed through the sleeve opening, and a spring plate fixedly mounted to an exterior surface of the sleeve, with the V-shaped spring projection mounted to the spring plate biasing the V-shaped projection through the sleeve opening interiorly of the sleeve for engagement selectively with said first annular groove and said second annular groove.

2. An awl as set forth in claim 1 wherein said handle includes a handle first end spaced from a handle second end, with the handle first end arranged in a facing relationship relative to the second annular groove, with the handle second end including a cavity directed into the handle from the handle second end, with the cavity coaxially aligned relative to the axis, and the handle having an annular abutment wall orthogonally oriented relative to the axis directed into the handle spaced from the handle second end, with an externally threaded handle wall extending from the abutment wall to the handle second end, with the container received within the cavity, and a handle cap arranged for threaded securement to the handle about the externally threaded handle wall.

3. An awl as set forth in claim 2 wherein the handle cavity includes a container mounted within said cavity, and the handle second end includes an annular resilient spring lip, and the container includes a container top wall spaced from a container bottom wall, and the container side wall includes a container annular groove positioned in adjacency to the container top wall, where the annular spring lip is arranged for projection into the annular groove to provide mounting of the container within the cavity.

4. An awl as set forth in claim 3 wherein the container includes a porous sponge applicator projecting through the container top wall, with the porous sponge applicator including a dye solution arranged for application to a work surface.

* * * * *